United States Patent [19]

Grigorenko et al.

[11] 4,191,044

[45] Mar. 4, 1980

[54] HYDRAULIC SCREW PRESS

[76] Inventors: Anatoly S. Grigorenko, ulitsa Tovstukho, 1, kv. 2; Jury A. Moroz, ulitsa Fugenfirova, 3, kv. 91; Leonid I. Kortusov, prospekt Mira, 57a, kv. 10, all of Omsk; Jury A. Bocharov, 15 Parkovaya ulitsa, 18, korpus 1, kv. 109; Anatoly V. Safonov, Sevastopolsky prospekt, 51, korpus 1, kv. 11, both of Moscow, all of U.S.S.R.

[21] Appl. No.: 928,388

[22] Filed: Jul. 27, 1978

[51] Int. Cl.[2] ..... B21J 1/18

[52] U.S. Cl. ..... 72/354; 72/407; 72/454

[58] Field of Search ..... 72/454, 407, 354, 357; 100/270

[56] References Cited

U.S. PATENT DOCUMENTS

| | | | |
|---|---|---|---|
| 3,271,991 | 9/1966 | Monahan | 72/407 |
| 3,422,658 | 1/1969 | Michelson | 72/407 |
| 3,507,143 | 4/1970 | Georg | 100/270 |
| 3,512,467 | 5/1970 | Georg | 72/454 |
| 4,069,700 | 1/1978 | Bocharov et al. | 72/454 X |

*Primary Examiner*—Leon Gilden

*Attorney, Agent, or Firm*—Burgess, Ryan and Wayne

[57] ABSTRACT

A press featuring double-ended pressing action upon the blank, made use of in pressforging practice. The frame of the proposed press mounts the slides carrying the female die halves and those carrying the male dies, both of said groups of slides reciprocating towards each other. The slides carrying the male dies are actuated from the hydraulic power cylinders linked with their movable members to the slides through lead screws which in turn interact through their threading with the fly-wheels rotatably mounted on the frame. The essence of the invention resides in that the lead screws with their one end are movable associated with the male-die carrying slides and with the other end they are locked-in with the movable members of the hydraulic power cylinders actuating said screws, while the flywheels are interconnected through a mechanical gearing. It is due to the aforesaid feature that the press proposed herein provides for high accuracy of pressforging, endurance of die sets and operational reliability thereof.

3 Claims, 5 Drawing Figures

HYDRAULIC SCREW PRESS

The present invention relates generally to press-forging machinery and more particularly to hydraulic screw presses featuring a double-ended pressing action upon the blank.

FIELD OF THE INVENTION

In recent years, the development of screw presses towards the provision of specialized machines which are capable of closed-die forging with the use of composite dies.

It is known commercially that closed-die forging by means of a three-dimensional forming process is the most efficient way of producing accurate forgings. To this end use is made of specialized presses provided with a die locking and releasing mechanism.

BACKGROUND OF THE INVENTION

Prior-art screw presses are known to comprise two slides, i.e., inner and outer ones. The outer slide serves for locking and clamping the die, while the outer slide deforms the blank in a closed die. Such presses serve for producing the forgings of a definite type, e.g., hubbed gears, flanges, and the like, which are produced by single-ended pressing of the blank.

To produce a definite kind of forgings, such as, say, stem-pinion, closed-die forging by virtue of double-ended pressing should be resorted to.

Deformation by virtue of double-ended pressing is preferable to single-ended as the source of plastic deformation is arranged symmetrically, there occurs no restriction to plastic of a single-ended deformation, losses due to friction of metal against the die walls are reduced and specific efforts applied are diminished.

Another hydraulic screw press operating on the double-ended pressing principle is known to comprises a horizontal frame which mounts the slides carrying female die halves and the slides carrying male dies, both of said groups of slides being adapted to reciprocate against each other, each of the slides having a self-contained drive of its own. The male-die carrying slides obtain drive from hydraulic cylinders linked with their movable members to said slides through lead screws which are adapted to interact through their threading, with the flywheels rotatably mounted on the frame. The lead screws are locked-in with the slides, whereas the interior space of the hydraulic cylinder is in fact the hollow of the lead screw and the cylinder rod is made fast on the frame.

The slides carrying the female die halves is imparted motion from hydraulic cylinders which are also adapted to establish the clamping force for the die halves in the course of the press-forging process.

To establish synchronism of movement of the slides carrying the male dies, the slides are interconnected through the lead screws provided with a non-selflocking thread (cf. USSR Inventor's Certificate No. 294,411).

In the press discussed hereinbefore, torque reaction resulting from interaction of lead screws and flywheels, is relayed to the slides since they are locked-in with the lead screws, and further on to the frame ways. This leads to an abnormally high wear on the ways, disturbs their adjestment and affects adversely the travelling accuracy of the slides which in turn tells badly on the dimensional accuracy of forgings produced, reduces the endurance of the die sets and reliability and service life of the press as a whole.

The dimensional accuracy of forgings is also affected by the presence of considerable axial plays in the non-selflocking thread of the lead screws in the travelling synchronization system of the male-die carrying slides.

OBJECT AND SUMMARY OF THE INVENTION

It is a primary object of the present invention to provide a hydraulic screw press which would ensure an adequate press-forging accuracy.

It is another object of the present invention to provide a hydraulic screw press that would feature high operational reliability.

It is one more object of the present invention to provide a hydraulic screw press which would assure high endurance of the die sets involved.

Said and other objects of the present invention are accomplished in a press the frame of which mounts a number of slides carrying female die halves and a number of slides carrying male dies, both of the groups of slides being capable of reciprocating against each other, each of the abovesaid slides having a self-contained drive of its own, the slides carrying male dies being interconnected through a synchronization mechanism and obtaining drive from hydraulic cylinders which are linked, with their movable members, to the slides through lead screws adapted to interact, through the threading thereof, with flywheels rotatably mounted on the frame, wherein according to the invention the lead screws with their one end are articulated to the male-die carrying slides and with the other end are locked-in with the movable members of the hydraulic cylinders imparting motion thereto, said members being adapted to reciprocate along the frame, whereas the flywheels are interconnected through a mechanical gearing.

The press according to the present invention is capable of press-forging in closed dies with high dimensional accuracy of forgings obtained. This is attainable due to the fact that the lead screws are articulated to the slides, whereby torque reaction resulting from the interaction of the lead screw and the flywheel is not transmitted to the slide. Therefore the ways of the slides are less subject to premature wear and hence their adjustment is no longer liable to be upset, and the accuracy of travelling direction of the slides is not affected, said accuracy in turn influencing the dimensional accuracy of forgings obtained and the endurance of the die sets used.

It is expendient that the hydraulic cylinder actuating the male-die carrying slides be of the plunger type and that the plunger of said cylinder be locked-in with the frame, while its barrel be mounted in the frame ways adapted to take up torque reaction resulting from the interaction of the lead screw and the flywheel.

Such an embodiment of the slide actuating hydraulic cylinder is constructionally most simple one, can easily be made and is reliable in iperation.

Application of a single-acting plunger-type hydraulic cylinder of a simpler construction rather than of a double-acting piston-type hydraulic cylinder is rendered practicable due to the fact than it is operative during the working stroke only, whereas the return stroke of the slides carring male dies is by virtue of their interaction with the slides carrying female die halves.

Furthermore, in the press according to the invention the lead screws may have the thread of the same hand, and the mechanical gearing interconnecting the flywheels may be implemented with an odd number of steps.

Provision of the lead screws having the same hand of thread is most simple from construction viewpoint, renders the screws easily productioneered and reliable in operation.

In addition, in such an embodiment of the lead screws the flywheels rotate in opposite directions, whereby torque reactions developed by the both of the screw-and-nut pairs have opposite signs and are taken up by the frame. That is why the foundation of the press is relieved from forces developed by the press and is not therefore subject to destruction.

BRIEF DESCRIPTION OF THE DRAWINGS

In what follows the present invention is ullustrated by way of a specific exemplary embodiment thereof to be had in conjunction with the accompanying drawings, wherein.

DETAILED DESCRIPTION OF THE INVENTION

Figure 1:
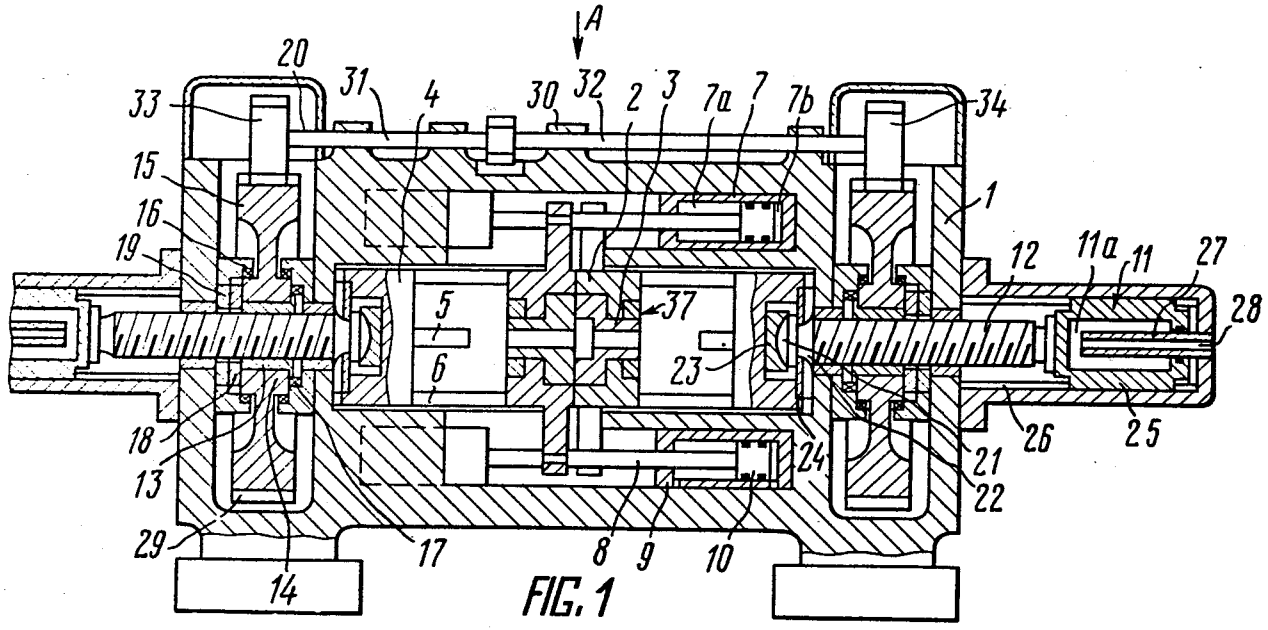
FIG. 1 is a general longitudinal section view of a hydraulic screw press, according to the invention.

Proposed in the present invention is a hydraulic screw press featuring double-ended pressing upon the blank, comprising a frame 1 (FIG. 1) which mounts slides 2 carrying female die halves 3, and slides 4 carrying male dies 5, both of the abovesaid groups of slides being adapted to reciprocate against each other.

Reciprocating motion of said slides 2 and 4 towards each other is effected due their being mounted in ways 6 provided in the frame 1.

Traversing of the slides 2 carrying the female die halves 3 results in locking or releasing of the latter, while traversing of the slides 4 carrying the male dies 5 effects working or idle stroke of the latter dies.

Each of the slides 2 and 4 has a self-contained drive for being traversed therefrom.

The slides 2 have hydraulic power cylinders 7 as actuators of their traversing, each of the cylinders being linked through its movable member, viz., a rod 8, to the slide 2 and having a barrel 9 located on the frame 1. The interior of the barrel 9 accommodates a piston 10 locked-in with the rod 8.

The slides 4 are traversable from hydraulic power cylinders 11 which are linked with their movable members to the slides 4 through lead screws 12 provided with non-selflocking thread and featuring the helix angle in excess of the angle of friction.

The lead screws 12 are adapted to interact with nuts 13 which are fixed in position in nubs 14 of flywheels 15 pivotally mounted on the frame 1.

Rotatability of the flywheels 15 is established due to their being journalled in annular bearings 16.

An antifriction thrust bearing 17 is between one face of the hub 14 of each flywheel 15 and the frame 1 to take up axial thrust.

Held to the other face of the hub 14 is a flat ring pivot 18, while a thrust ring 19 adapted to interact therewith, is made fast on the frame 1.

The slides 4 carrying the male dies 5, are interconnected through a synchronization mechanism 20 to establish synchronism in their travelling against each other during the working stroke and thus to provide stable dimensional accuracy of forgings produced.

According to the invention the lead screws 12 with one of their ends are articulated to the slides 4 carrying the male dies 5, said articulated joints being effected by virtue of a spherical pivot 21 and a recess 22 provided at the end of each of the lead screws 12.

The slide 4 carries a spherical socket 23 adapted to interact with the pivot 21, and a split flange 24 held in place thereto and adjoining the recess 22.

The other ends of the lead screws 12 are locked-in with the movable members of the hydraulic power cylinders 11, said members being mounted on the frame 1 so as to reciprocate therealong.

Barrels 25 of the hydraulic power cylinders 11 serve in this case as the movable members of the cylinders.

Reciprocating motion of said barrels 25 is effected due to their being mounted in ways 26 provided in the frame 1 and adapted to take up torque reaction resulting from interaction of the lead screws 12 and the flywheels 15.

The hydraulic power cylinder 11 is of the plunger type, a plunger 27 being accommodated in an interior space 11*a* of the barrel 25 and locked-in with the frame 1, a passageway 28 being provided in the plunger 27 for power fluid to feed therethrough.

The flywheels 15 are interconnected through a mechinical gearing in the capacity of which use is made of a gear train.

Teeth 29 are provided on the outer cylindrical surface of the flywheels 15 for their meshing with the aforesaid gear train.

Figure 2:
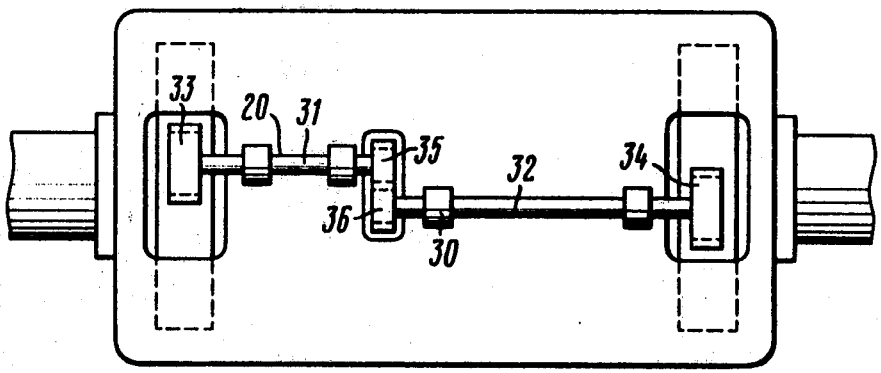
FIG. 2 is a general view taken along the arrow A in FIG. 1.

The lead screws 12 have the same hand of thread so that their rotation against each other results in the flywheels rotating in opposite directions; that is why the gear train incorporates an odd number of steps (three in this particular case). This is attained due to the fact that two shafts 31 and 32 (FIG. 2) are journalled in annular bearings 30 on the frame 1.

Gears 33 and 34 are held to the extensions of the respective shafts 31 and 32 so as to get in mesh with the teeth 29 of the flywheels 15.

The other extensions of the shafts 31 and 32 carry respective gears 35 and 36 fixed in place thereon so as to mesh each other.

OPERATION

The press proposed in the present invention operates as follows. Prior to working stroke of the dies 5 the slides 2 carrying the female die halves 3, get locked together in the middle portion of the frame 1 so that the female die halves 3 form a closed die 37 as can be seen from FIG. 1.

As a result, the rod spaces 7*a* of the hydraulic power cylinders 7 are communicated with the source (not shown) of power fluid, whereas the piston spaces 7*b* of said hydraulic cylinders establish communication with the fluid return line. The force of the hydraulic cylinders 7 is imparted through the rods 8 to the slides 2, thus locking the die halves 3 together along the jointing plane thereof.

Figure 3:
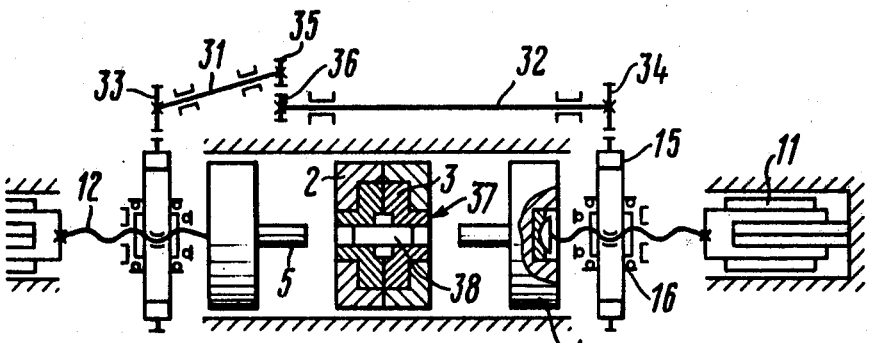
FIG. 3 shows the male-die carrying slides while in the position before working stroke.

Then a preheated initial blank 38 (FIG. 3) is inserted through the aperture of the die halves 3 into the closed die 37 from the side thereof.

Then the spaces 11*a* of both hydraulic power cylinders 11 are simultaneously communicated with the source of power fluid, viz. the hydropneumatic accumulator (not shown).

Pressure exerted by power fluid upon the bottom of the space 11*a* of the barrel 25 defines a constant effort urging said barrel to traverse along the ways 26 of the frame 1.

While the barrel 25 travels the lead screw 12 locked-in therewith performs translational motion as well and causes to move the slide 4 along with the male die 5 while acting through the pivot 21 and spherical socket 23.

Translational motion performed by the lead screws 12 results in rotary motion imparted to the nuts 13 interacting with the screws 12 through non-selflocking thread thereof.

The flywheels rotates in the annular bearings 16 alongside with the nuts 13, while axial thrust resulting from interaction of the screw 12 and the nut 13 is relayed to the frame 1 through the thrust bearing 17, and torque reaction is transmitted to the ways 26 of the frame 1 by virtue of a rigid linking established between the screw 12 and the barrel 25.

At the same time no torque is imparted to the ways 6 of the slides 4 due to an articulated joint between the screws 12 and the slides 4. This reduces wear on the ways and contributes to higher dimensional accuracy of forgings and endurance of the die sets used, As the leads screws 12 has the thread of the same hands the flywheels 15 rotate in the opposite directions; thus, torque reactions developed by both of the screw-and-nut pairs acts in the opposite directions and are taken up by the frame 1, thereby developing no destabilizing moment and imposing no load upon the foundation.

Rotation from the flywheels is transmitted via the gears 33 and 34 to the shafts 31 and 32 which are interconnected through an intermediate gearing made up by the gears 35 and 36. Provision of a gear train interconnected the flywheels 15 accounts for their equal peripheral speeds during working stroke. Thereby the slides 4 are made to travel against each other in synchronism due to their being associated with the flywheels 15 through the lead screws 12.

In the course of working stroke the speed of all the movable press elements rises until the male dies 5 meet the blank 38. This is accounted for by the fact that when power fluid is fed from the hydropneumatic accumulator (not shown) to the hydraulic cylinders 11, a nearly constant exial thrust is developed on the barrel 25 and the lead screw 12, whereby a uniformly accelerated motion is ensured.

While being accelerated the movable elements of the press accumulate kinetic energy of rotary motion (as the flyheels 15 are concerned) and of translational motion (which refers to the cylinder barrels 25, the lead screws 12 and the slides 4.

At the end of working stroke the male dies carried by the slides 4, enter the apertures of the female die halves 3 to deliver below against the blank 38 so as to deform it in the closed die 37. As a result, kinetic energy accumulated in the course of working stroke, is converted into plastic strain work of the initial blank 38.

The provision of a synchronization mechanism 20 as a mechanical gearing interconnecting the flywheels 15 defines synchronism of traversing of the slides 4 with the male dies 5, whereby high dimensional accurancy of forgings is attained.

Figure 4:
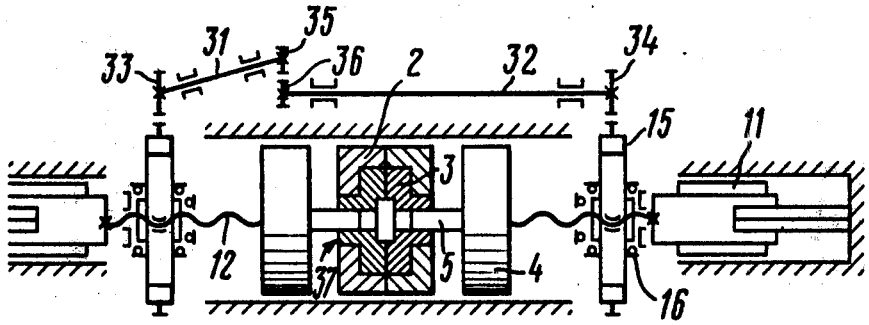
FIG. 4 shows the male-die carrying slides while in the position after working stroke.

Working stroke completed, the slides 4 remain in the final position as shown in FIG. 4.

Press-forging process over, one must extract the finished forging from the female die. To this end, the piston spaces 7*b* of the hydraulic cylinders 7 are communicated with the source of pressure, whereas the rod spaces 7*a* are communicated with the return line; the spaces 11*a* of the hydraulic cylinders 11 get communicated with the return line as well.

As a result, the slides 2 are made to traverse along the ways 6 by virtue of the forces developed by the hydraulic cylinders 7, so as to release the female die halves 3. Concurrently, the finished forging is knocked out from one of the female die halves 3, wherein it remains after the latter have been released, due to interaction of the forging with one of the male dies 5. The knocking-out force can be adjusted by establishing a back pressure in the spaces 11*a*, or by braking the flywheels 15.

The fact that the finished forging is knocked out immediately after completting the press-forging process adds to endurance of the die set to a reduced time of residence of the forging in the interior space of the die 37.

Figure 5:
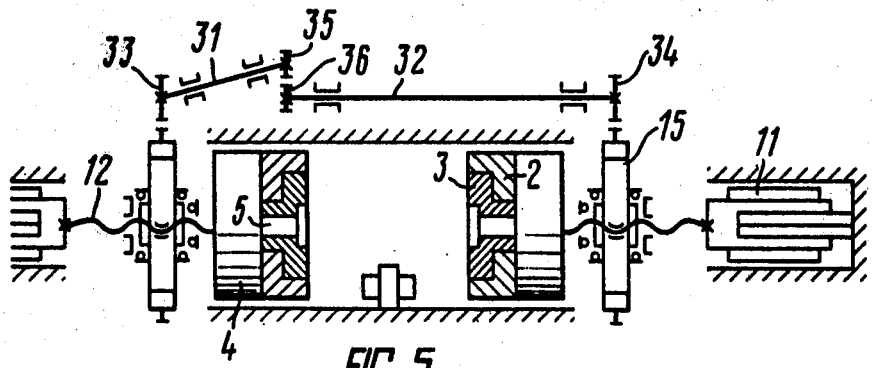
FIG. 5 shows the male-die carrying slides with the die halves brought apart after the finished forging has been knocked out therefrom.

Then the slides 2 keeps bringing apart meeting the slides 4, whereupon a simultaneous idle travel of the latter occurs till thrusting against the frame 1 as shown in FIG. 5.

A joint travelling of the slides 2 and 4 down the iperating cycle time of the press.

What we claim is:

1. A hydraulic screw press featuring double-ended pressing action upon the blank, comprising: a frame; female die halves; slides carrying said female die halves, said slides being reciprocatingly mounted on said frame; male dies; slides carrying said male dies, said slides being mounted on said frame so as to reciprocate against said slides carrying said female die halves; a traversing synchronization mechanism interconnecting said slides carrying said male dies; flywheels pivotally mounted on said frame and interconnected through a mechanical gearing; hydraulic power cylinders of said traversing actuator of said slides carrying said male dies, movable members of said hydraulic power cylinders mounted reciprocatingly with respect to said frame; lead screws adapted to interact through their threading, with said flywheels, said lead screws being articulated at one end thereof to said slides carrying said male dies and with the other end being locked-in with said movable members of said hydraulic power cylinders.

2. A hydraulic screw press as claimed in claim 1, wherein said hydraulic cylinder actuating said slides carrying said male dies is of the plunger type, and that the plunger thereof is locked in with said frame, whereas its barrel is mounted in ways so as to traverse along said frame, said ways being adapted to take up torque reaction resulting from interaction of said lead screw with said flywheel.

3. A hydraulic screw press as claimed in claim 1, wherein said lead screws have the same hand of thread, and the mechinical gearing interconnecting said flywheels incorporates an odd number of steps.

* * * * *

UNITED STATES PATENT OFFICE

CERTIFICATE OF CORRECTION

Patent No. 4,191,044 Dated March 4, 1980

Inventor(s) Anatoly S. Grigorenko, et al

It is certified that error appears in the above-identified patent and that said Letters Patent are hereby corrected as shown below:

Column 1, line 66: "adjestment" should be --adjustment--.

Column 3, line 16: "ullustrated" should be --illustrated--.

line 42: after "due" insert --to--.

Column 4, line 35: "chinical" should be --chanical--.

Column 6, line 25: "completting" should be --completing--.

lines 34-35: "iperating" should be --operating--.

line 65: "mechinical" should be --mechanical--.

Signed and Sealed this

*Second* Day of *September 19*

[SEAL]

*Attest:*

SIDNEY A. DIAMOND

*Attesting Officer*

*Commissioner of Patents and Trademar*